United States Patent [19]

Looney

[11] Patent Number: 5,052,678

[45] Date of Patent: Oct. 1, 1991

[54] DUPLEX FEEDER WITH SIDE SHIFTING INVERSION

[75] Inventor: John H. Looney, Fairport, N.Y.

[73] Assignee: Xerox Corporation, Stamford, Conn.

[21] Appl. No.: 406,491

[22] Filed: Sep. 13, 1989

[51] Int. Cl.[5] ..... B65H 29/00; B65H 9/00

[52] U.S. Cl. ..... 271/186; 271/225; 271/251; 271/291

[58] Field of Search ..... 271/184p14 186, 251, 271/225, 291; 355/318-319

[56] References Cited

U.S. PATENT DOCUMENTS

| | | | |
|---|---|---|---|
| 4,019,435 | 4/1977 | Davis | 271/186 |
| 4,027,870 | 6/1977 | Frech et al. | 271/186 |
| 4,050,805 | 9/1977 | Hage | 355/14 |
| 4,155,440 | 5/1979 | Bogdanski et al. | 271/185 |
| 4,266,762 | 5/1981 | Kramer et al. | 271/186 |
| 4,477,068 | 10/1984 | Aster et al. | 271/186 |
| 4,660,963 | 4/1987 | Stemmle | 355/24 |
| 4,699,503 | 10/1987 | Hyltoft | 355/145 H |
| 4,708,462 | 11/1987 | Stemmle | 355/24 |
| 4,727,397 | 2/1988 | Stemmle | 355/24 |
| 4,787,616 | 11/1988 | Sasaki et al. | 271/291 |
| 4,884,794 | 12/1989 | Dinatale | 271/186 |
| 4,903,043 | 2/1990 | Tajima | 271/185 |
| 4,909,374 | 3/1990 | Skrypalle | 271/265 |
| 4,972,236 | 11/1990 | Hasegawa | 271/291 |
| 4,988,088 | 1/1991 | Aiba | 271/186 |

FOREIGN PATENT DOCUMENTS

| | | | |
|---|---|---|---|
| 57759 | 5/1979 | Japan | 271/186 |
| 61-172165 | 8/1986 | Japan . | |

OTHER PUBLICATIONS

Acquaviva, T. "Document Reverter" *Xerox Disclosure Journal*, vol. 7, No. 1 (Jan/Feb. 1982), pp. 11-12.

Brooke, E. R."Duplex Photocopier" *Xerox Disclosure Journal*, vol. 4, No. 1 (Jan./Feb. 1979), p. 111.

*Primary Examiner*—Robert P. Olszewski

*Assistant Examiner*—Steve Reiss

[57] ABSTRACT

An automatic printing machine for producing successive duplex prints forms an image on a first side of successive print substrates, transports successive substrates having images on a first side through the machine to form images on the opposite side of the substrate. The substrate transport path inverts each successive substrate twice about an axis perpendicular to the direction of the path and has a side shifting inverter to invert successive substrates once about an axis parallel to the path direction and includes a first substrate guide with a top sheet insertion baffle and a bottom sheet insertion baffle defining a portion of the substrate transport path, one of the baffles having at least one aperture for a rotatable segmented drive roll having a flat segmented portion and a curved segmented portion, the curved portion extending through the aperture when the drive roll is rotated to be in substrate driving engagement with the remaining baffle, the flat segmented portion of the drive roll not extending through the aperture when adjacent the aperture. The inverter further include a direction reversing arcuate substrate guide to guide a substrate around a direction reversing path about an axis parallel to the path direction and a transport to transport a substrate through the arcuate guide. In a preferred embodiment the inverter portion of the duplex path is in a removable cassette which is interchangeable with a print substrate cassette.

31 Claims, 6 Drawing Sheets

DUPLEX FEEDER WITH SIDE SHIFTING INVERSION

CROSS REFERENCE TO RELATED APPLICATION

Attention is directed to U.S. application Ser. No. (D/88042) entitled "SHORT EDGE FEED DUPLEX WITH SIDE SHIFTING INVERTER" filed concurrently herewith in the name of Denis J. Stemmle.

BACKGROUND OF THE INVENTION

The present invention relates to print substrate handling and duplex reproduction and more particularly to a short edge feed duplex operation producing book style duplex prints.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

Duplex copying, i.e. copying image information to both sides of a single sheet of paper, is an important feature in copying machines. Duplex copying is desirable because it reduces the amount of paper required in copying in comparison to simplex (single side) copying, produces attractive copy sets, and can simulate the appearance of a printed book. Generally, such copying is accomplished in either one of two methods. In a first method, first side copies are produced in a reproduction processor and stacked in a duplex tray. When a set of first side copies is complete, the copies are fed out of the duplex tray and returned to the reproduction processor with an odd number of inversions in the total duplex path to receive second side image information, and subsequently passed to an output. Alternatively, first side copies may each be returned directly to the reproduction processor to receive second side copies thereon, without stacking, for example, as described in U.S. Pat. No. 4,660,963). This type of copying finds particular use with respect to copying two documents placed on a platen for sequential copying, sometimes referred to as two-up copying.

Book style duplex copying, as used herein refers to the production of duplex copy sets which are suitable for reading as a book from top to bottom from the same sheet edge, with the image top portion on both sides of the sheet adjacent the top edge of the sheet, for binding along a side edge with respect to the image. This portrait style image appearance is generally only achieved in the present duplex-capable reproduction machines, however, when copy sheets are fed through the reproduction processor to receive image information on one or both sides of the copy sheet with the image top to bottom alignment or orientation, as the image is normally viewed, oriented on the sheet transverse to the direction of sheet feeding. When duplex copies are made with image top to bottom alignment oriented on the sheet in the direction of sheet travel in the same reproduction machines, the resulting two-sided copies do not have the top portions of the image along a common edge of the sheet. Instead, the image top portions are adjacent opposed edges on each side of the sheet, which, when the copy set is bound along a side edge in a book style format, provides the second sides of the sheets upside down with respect to the first sides of the sheets. This type of copying is sometimes called military style duplex, and hereinafter referred to as pad style duplex, provides easy viewing only if the copy set is bound along the top edge and read by turning pages upwardly to read the back side of each sheet. While pad style duplex copying has certain applications, it is frequently undesirable in duplex copying usage.

Heretofore, in duplex capable copying machines where it has been desirable to provide book style duplex copying from simplex originals, it has been necessary for the machine to provide a paper path and processor accommodating LEF (long edge first) sheets and place images on the sheet having a top to bottom alignment oriented transverse to the direction of sheet travel. This arrangement adds significantly to the cost of the machine, as it requires the paper path and processing elements to accommodate the long edge of sheets fed through the machine. In very low cost machines it is desirable to provide only a narrow processor, accommodating for example, $8\frac{1}{2}\times 11$ inch sheets fed SEF (short edge first). The width of the paper path and processing elements in such a machine are only required to accommodate the $8\frac{1}{2}$ inch length of the sheet as opposed to a machine required to accommodate at least 11 inch widths to accommodate the long edge feed of $8\frac{1}{2}\times 11$ inch sheets. However, this narrow process width arrangement ordinarily precludes the desirable book style duplex from simplex documents, as the bulk of simplex documents copied have images oriented with the image top portion adjacent a short edge of the document sheet. Alternatively, an operator desiring to produce duplex copies from simplex documents on SEF sheets, must manually rotate every other document to be copied by 180° prior to copying. This is inconvenient, and potentially confusing, allowing the possibility of operator errors. Additionally, such an arrangement precludes the simple use of automatic document feeders to feed the set of documents to be copied past the platen, as an operator seeking to take advantage of the increased speed in automatic document handling must manually prepare the set of simplex documents to be copied with every other sheet rotated with respect to the previous sheet, and re-order the document set subsequently to copying.

PRIOR ART

Xerox Disclosure Journal, Vol. 4, No. 1, Jan./Feb. 1979, "Duplex Photocopier", E. R. Brook et al. describes a photocopier having automatic duplex copying capability in which the copy paper is fed short edge first so that the copy paper must be transported from the transferring nip after simplex copying, inverted and returned to the nip retaining the same lead edge. After the first side is transferred, the copy paper is transported away from the transfer nip, rotated through 180° on a transport, moved sideways at right angles to its previous direction of feed, and rotated through 180° about its long axis and deposited into a buffer tray. The first side copies are then fed out of the tray and rotated once again through 180° and returned to the transfer nip for the second side image.

The above referenced copending application is directed to a device which overcomes a productivity or thruput deficiency inherent in the Brook et al. device. In that device during the transition from inverting the first copy about its short edge to inverting it about its long edge and in the transition between inverting it about its long edge to inverting it about its short edge two large gaps between successive sheets equal to the largest dimension of the print will necessarily be formed since a successive print cannot be fed until the preceding print has totally left its place in the paper path. The above referenced copending application solves this problem by providing a means associated with a side shifting inverter to enable the corners of successive substrates entering and exiting the side shifting inverter to be overlapped by substrates being transported in the path direction through the inverter.

The present invention is directed to an alterntive apparatus for implementing the duplexing operation of Brook et al. or the above referenced Stemmle application.

SUMMARY OF THE INVENTION

In accordance with a principle aspect of the present invention an automatic printing machine for producing successive duplex prints is provided which has means to form an image on the first side of successive print substrates and a substrate transport path to transport successive substrates having images on a first side to form images on the opposite side of the substrate by inverting each successive substrate twice about an axis perpendicular to the direction of the substrate path and a side shifting inverter to invert successive substrates about an axis parallel to the substrated path which comprises a first substrate guide means comprising a top insertion baffle and a bottom sheet insertion baffle defining a portion of the substrate transport path, one of the top and bottom sheet insertion baffle having at least one aperture therein through which the curved portion of a segmented drive roll having a flat segmented portion and a curved segmented portion extends to be in substrate driving engagement with the remaining baffle and further including a direction-reversing arcuate substrate guide means to guide a substrate around the direction reversing path about an axis parallel to the path direction together with means to transport a substrate through the arcuate guide means.

In accordance with a further aspect of the present invention the direction reversing arcuate substrate guide means comprises an arcuate inner turn baffle and an arcuate outer turn baffle defining a portion of the substrate transport path therebetween with the inner turn baffle having at least one aperture therein through which at least one rotatable drive roll extends into the substrate transport path for transporting a substrate.

In accordance with a further aspect of the present invention at least one spring shoe is provided for engagement with each of at least one drive roll, rotatable segmented drive roll and registration roll to form a substrate driving nip therebetween.

In a further aspect of the present invention a second substrate guide means downstream in the substrate transport path from the drive roll is provided comprising upper and a lower guide baffle and including means to deskew and register successive substrates along an edge parallel to the direction of the substrate transport path including an aperture in one of the upper or lower guide baffles and a rotatable segmented registration roll having a flat segmented portion and a curve segmented portion which extends through the aperture when the registration roll is rotated to be driving engagement with the remaining baffle and canted with respect to the registration edge to provide deskewing and registration of a substrate when a substrate is driven by the registration roll toward the registration edge.

In a further aspect of the present invention the substrate transport path sequentially includes means to invert successive substrates about an axis perpendicular to the direction of said path. the inverter to invert successive substrates about an axis parallel to the path direction and second means to invert successive substrates about an axis perpendicular to the direction of the path.

In a further principle aspect of the present invention the inverter and a portion of the substrate transport path on each side of the inverter are included in a cassette removable from the printing machine which is interchangeable with a normal print substrate cassette.

In a further aspect of the present invention the inner and outer arcuate turn baffles of the cassette each comprise an upper and lower section and the upper section of the inner turn baffle is connected to the lower guide baffle of the second substrate guide means, the upper section of the outer guide baffle is connected to the upper guide baffle of the second substrate guide means, the lower section of the inner turn baffle is connected to the top substrate insertion baffle of the first substrate guide means and the lower section of the outer guide baffle is connected to the bottom substrate insertion baffle of the first substrate guide means.

In a further aspect of the present invention the bottom substrate insertion baffle and the upper guide baffle are supported by and hingedly attached to a rear support member to enable pivotal movement away from the top sheet insertion baffle and lower guide baffle respectively.

In a further aspect of the present invention the inner and outer arcuate turn baffles have raised rib portions to corrugate and thereby stiffen a substrate.

In a further aspect of the present invention the top sheet insertion baffle and the lower guide baffle are arranged to form an interior assembly within the upper guide baffle and the bottom sheet insertion baffle which includes at least one rotatable segmented drive roll, one drive roll and one rotatable segmented registration roll together with means to drive the rolls.

In accordance with a further aspect of the present invention the curved portion of the segmented drive roll has an arc sufficiently long to transport the lead edge of a substrate to the take away transport.

In accordance with a further aspect of the present invention, the first substrate guide means is positioned beneath the second substrate guide means and further including at least one flexible substrate restraining finger to urge a substrate in the first substrate guide means toward the bottom sheet insertion baffle and at least one flexible substrate restraining finger toward a substrate in the second substrate guide means toward the upper guide baffle.

Other features of the present invention will become apparent as the following description process and upon reference to the drawings.

DESCRIPTION OF THE PREFERRED EMBODIMENT

The invention will now be described with reference to a preferred embodiment of the automatic printing machine with a duplex path with a side shifting inverter.

Figure 1:
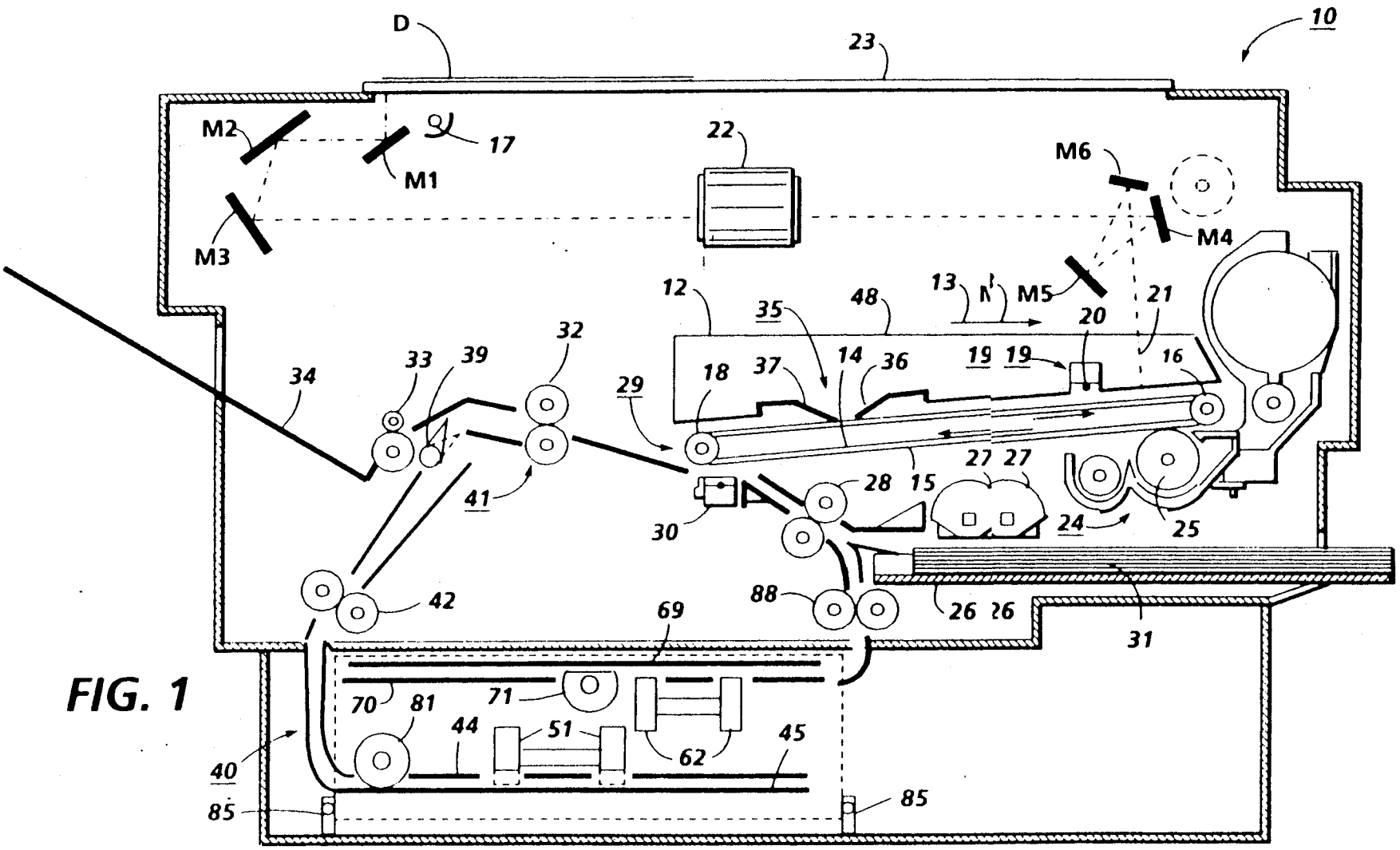
FIG. 1 is a schematic representation in cross section of an automatic printing machine with the duplex path and side shifting inverter according to the present invention.

Referring now to FIG. 1, there is shown by way of example, an automatic electrostatographic reproducing machine 10 illustrating the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems such as electronic printers and is not necessarily limited in application to the particular embodiment or embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23, lens 22 and mirrors $M_4$, $M_5$, $M_6$ to transmit the image to the photoconductive belt in known manner. The speed of the scanning carriage and the speed of the photoconductive belt are synchronized to provide a faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush development system including developer roll 25 utilizing a magnetizable developer mix having coarse magnetic carrier granules and toner colorant particles.

Sheets 31 of the final support material are supported in a stack arranged on elevated stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as the belt passes around the idler roll 18, and the sheet containing the toner image thereon is advanced to fixing station 41 wherein roll fuser 32 fixes the transferred powder image thereto. After fusing the toner image to the copy sheet the sheet 31 may be advanced by output rolls 33 to sheet stacking tray 34 or alternatively to duplex path side shifting inverter 40.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 37 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic xerographic copier 10 which can embody the apparatus in accordance with the present invention.

The operation of the duplex path side shifting inverter 40 will be described with continued reference to FIG. 1 and additional reference to the remaining Figures.

Figure 2:
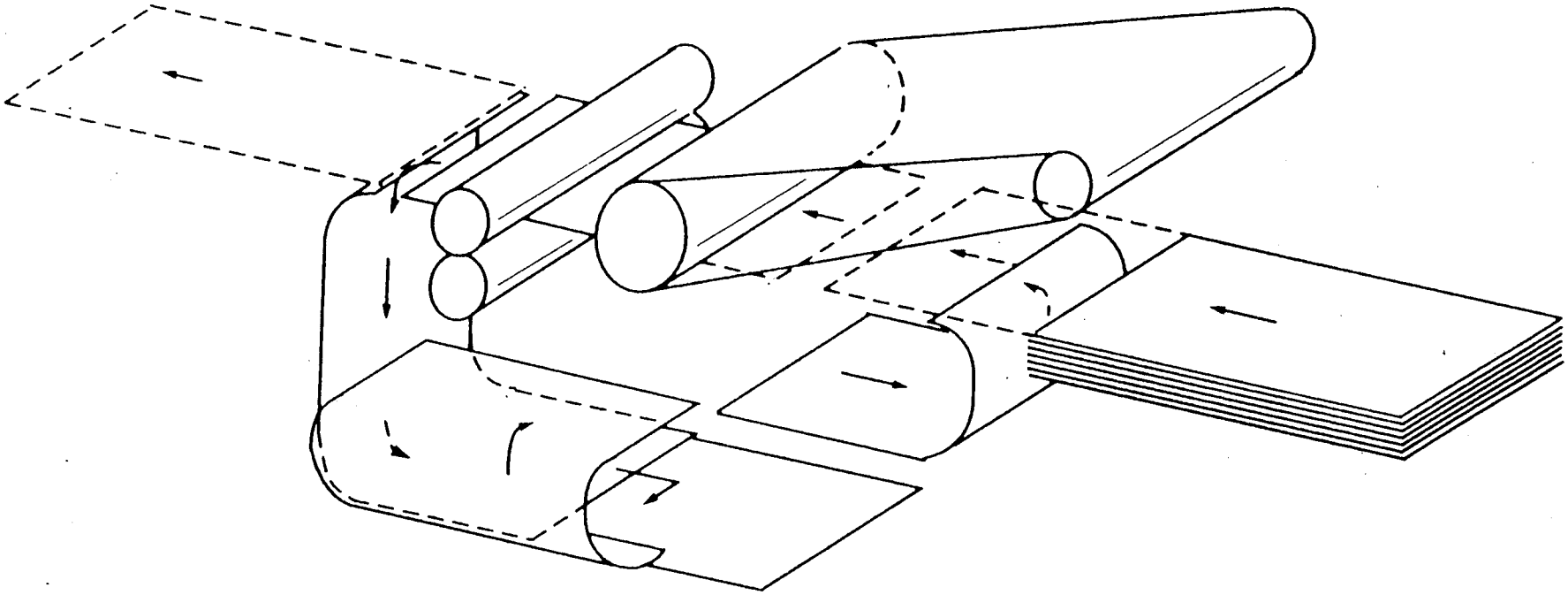
FIG. 2 is an isometric representation of the print substrate duplex path.
Figure 3:
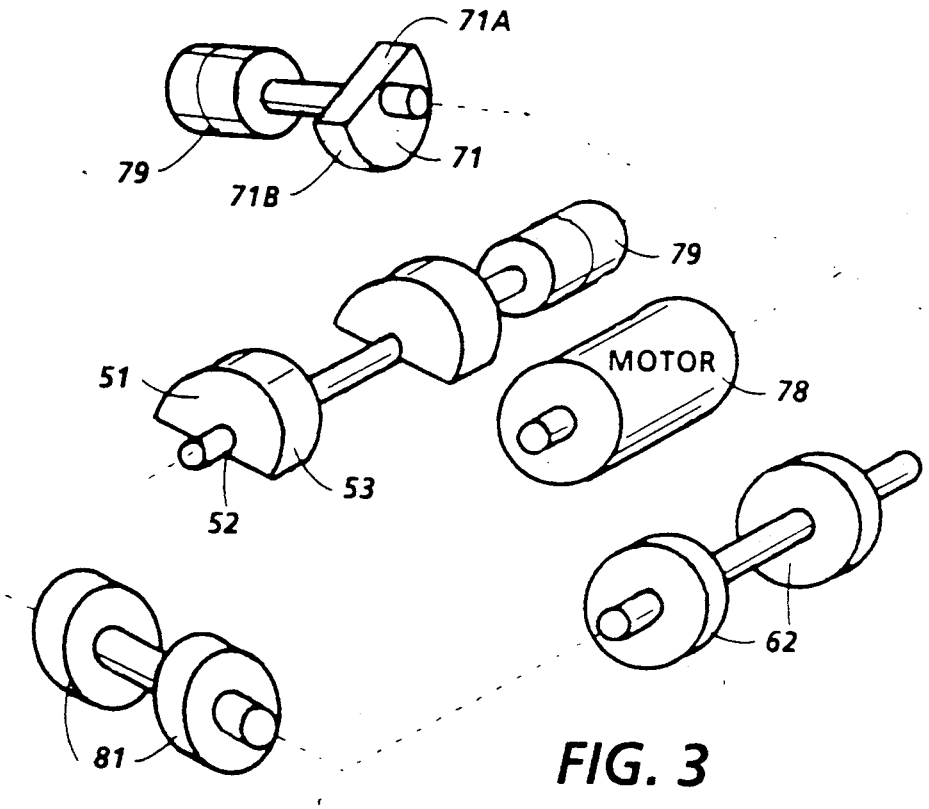
FIG. 3 is a isometric representation of the various drive mechanisms which may be contained within the interior assembly of the cassette.

FIG. 2 is an exploded isometric representation of the print substrate path from the support tray through the printing machine to receive a first image on a first side, through an inversion about an axis perpendicular to the direction of the path, through a side shifting inverter 40 where the print substrate is inverted about an axis parallel to the path direction and finally through a second inversion about an axis perpendicular to the direction of the path to arrive in the print substrate path just upstream of the first processing station in the printing machine, the belt 14, to receive a second image on the opposite side of the print substrate to form the duplex print.

With continued reference to FIGS. 3 through 6, the cassette duplex inverter embodiment will be described in greater detail. The print substrate path depicted in FIG. 2 is illustrated in the exploded view in FIG. 4 by the several arrows indicating that a print substrate is fed into the bottom of an inverter, inverted about an axis parallel to the substrate transport path and fed out the top of the inverter in the substrate transport path. As illustrated in FIGS. 3 through 6, the duplex inverter cassette comprises a first substrate guide means comprising a top sheet insertion baffle 44 and bottom sheet insertion 45. The bottom sheet insertion baffle in effect forms a bottom cover or lid for the cassette. It further cooperates with the other elements illustrated in FIG. 4 in defining a direction reversing arcuate substrate guide means 59*a*, *b* and 60*a*, *b* and a second substrate guide means 69, 70 to guide a substrate out of the inverter cassette and into its return substrate transport path.

Figure 4:
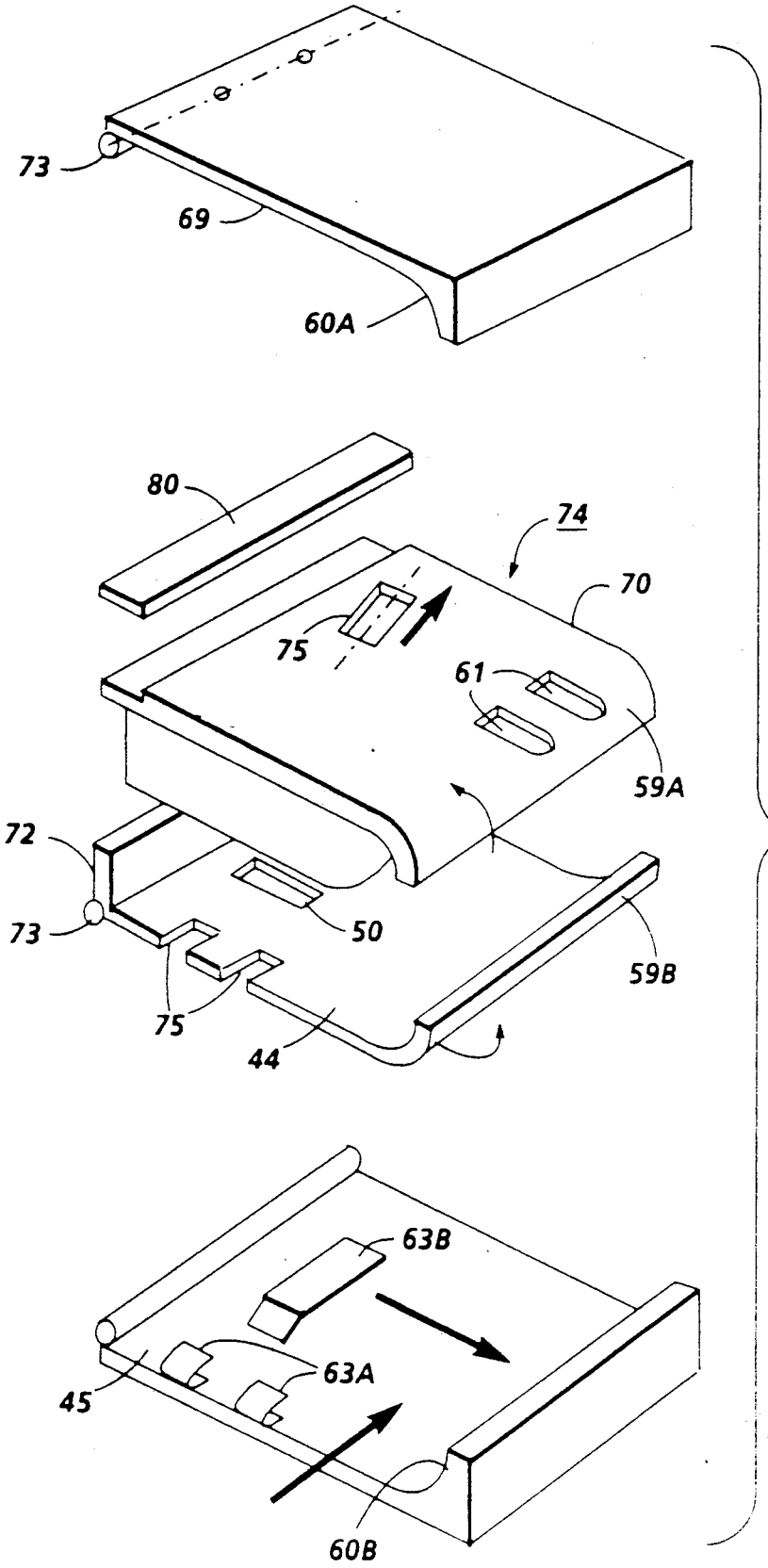
FIG. 4 is an exploded isometric view of the duplex cassette.

The direction reversing arcuate substrate guide means comprises an inner arcuate turn baffle 59 and an outer arcuate turn baffle 60 each of which include an upper section 59*a*, 60*a* and a lower section 59*b*, 60*b* as illustrated. The upper section of the inner turn baffle 59*a* is connected to the lower guide baffle 70 of the second substrate guide means 69, 70 while the upper section of the outer turn baffle 60*a* is connected to the upper guide baffle 69 of the second substrate guide means 69, 70. The lower section of the inner turn baffle 59*b* is connected to the top substrate insertion baffle 44 of the first substrate guide means 44, 45 and the lower section of the outer turn baffle 60*b* is connected to the bottom substrate insertion baffle 45 of the first substrate guide means 44, 45. Individual turn baffles may be employed and connected to the appropriate insertion and guide baffles. However, as illustrated in FIG. 4, the turn baffles may be formed integrally with the insertion and guide baffles if desired. As with the bottom sheet insertion baffle 45, the upper guide baffle 69 can function as a top lid for the cassette inverter. Furthermore, they both may be mounted to a rear support member 72 by means of hinge 73 to enable pivotal movement of the bottom sheet insertion baffle 45 and upper guide baffle 69 away from the top sheet insertion baffle 44 and the lower guide baffle 70 respectively to facilitate a jam clearance within the cassette as will be described in greater detail.

The top sheet insertion baffle 44 and the lower guide baffle 70 form an interior assembly 74 within the upper guide baffle 69 and the bottom sheet insertion baffle 45 which provides a housing for the various drive mechanisms as will be described hereinafter. The drive mechanism is more clearly illustrated in FIG. 3 and includes a pair of substrate feed-in rolls 81 which extend through the apertures 75 in the top sheet insertion baffle 44 and may be continuously driven to be in substrate driving engagement with spring shoes 63*a* on the bottom sheet insertion baffle 45. The spring shoes which typically have a slippery surface or low coefficient of friction and may be made from stainless steel, for example, provide the normal force to urge the substrate toward the feed rolls. The substrate inversion is initiated by activation of a rotatable segmented drive roll 51 having a flat segmented portion 52 and a curve segmented portion 53 which extends through an aperture 50 in the top sheet insertion baffle when rotated to provide driving engagement with a spring shoe 63*b* to drive the substrate through a direction reversing arcuate substrate guide means comprising the inner arcuate turn baffle 59*b* and the outer arcuate turn baffle 60*b*. The segmented drive roll 51 is parked with the flat side of the roll down when sheet is being fed by the substrate feed rolls 81 into the first substrate guide means. Once the substrate is in place, the segmented drive roll or rollers 51 are actuated through clutch 79 and rotated to extend the arcuate or curved portion through the aperture 50 to transport a sheet toward the direction reversing arcuate substrate guide means. The curved portion of the segmented drive roll has sufficient arc in one rotation to transport a substrate so that its lead edge will engage the nip between rotatable drive roll 62 and spring shoe 63*b*. After the one rotation the segmented drive roll is parked with the flat segmented portion down so that the next entering substrate will not hit the curved portion of the segmented drive roll but rather will be freely fed to the first substrate guide 44, 45.

The rotatable drive rolls 62 which may be constantly driven extend through aperture 61 in the lower guide baffle 70 and engage spring shoes (not shown) in the upper guide baffle 69 to transport a substrate around a direction reversing path into the second substrate guide means 69, 70 toward a registration edge 80 parallel to the direction of substrate transport path. The substrate is registered and deskewed by a flat segmented registration roll 71 having a flat segmented portion 71*a* and a curved segmented portion 71*b* the curve portion extending through an aperture 75 in the lower guide baffle 70 so that when the curved segmented portion is rotated it will extend through the lower guide baffle and engage a substrate driving it toward the registration edge 80 where it is deskewed and registered prior to being driven out of the cassette into take-away rolls 88. As with the segmented drive roll the arc on the segmented registration roll should have sufficient engagement with the substrate being transported to enable it to transport it to the take-away rolls 88.

Figure 5:
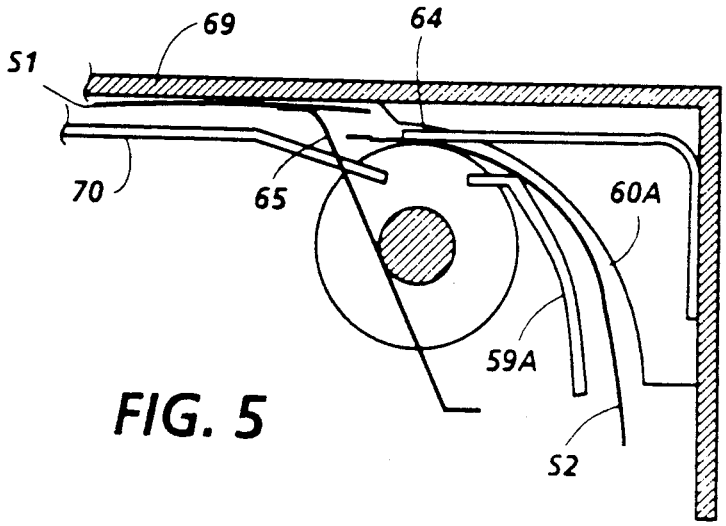
FIG. 5 is an enlarged cross-sectional view through one of the drive rolls illustrating a portion of the substrate transport path.
Figure 8:
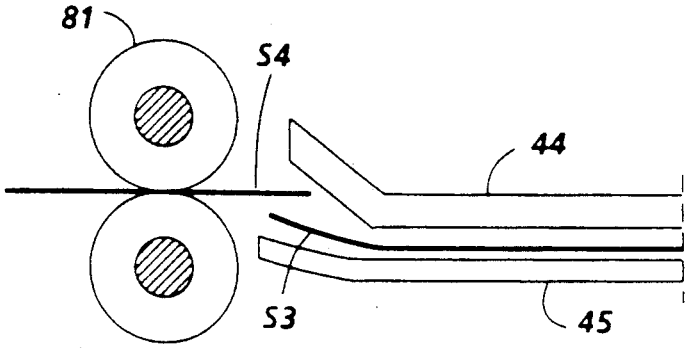
FIG. 8 is a cross-sectional view illustrating the overlapping of successive sheet substrates.

Typically the feed rolls, segmented drive roll, the rotatable drive rolls are made from a silicon rubber such as a HTV silicon rubber having a coefficient of friction of about 1.4 which enables them to have sufficient drive force to feed a typical substrate. On the other hand the segmented deskewing and registration roll typically has a somewhat lower coefficient of friction of the order of about 0.8 to enable a substrate to more readily deskew under the action of the roll. As with the segmented drive roll, the segmented registration roll is parked with the flat side down as a substrate is driven forward in the second substrate guide path by the drive rolls. The overlapping capability of successive substrates is more clearly illustrated with reference to FIGS. 5 and 8. In FIG. 5, substrate S1 is being transported by the segmented registration roll 71 (not shown) in a direction into the Figure whereas sheet S2 is being transported by upwardly and to the left by the drive roll 62 toward the second substrate guide path. The trail edge of S1 is urged upwardly by a plurality of flexible substrate restraining fingers 65 toward the upper guide baffle to enable insertion of the subsequent sheet by the drive roll in the second substrate guide path. Typically, the flexible restraining fingers are made from a thin polyester film such as 0.15 mm Mylar. Similarly, in the first sheet guide path, a plurality of fingers may be used to urge the leading substrate in the first substrate guide path downwardly toward the bottom sheet insertion baffle to enable a partial overlap of an incoming substrate from the feed rolls. Also, illustrated in FIG. 5, substrate S2 will contact flexible restraining fingers 65 and to enable it to have sufficient beam strength to deflect the flexible restraining finger a slight corrugation is formed in sheet S2 by means of ribs 64 in the inner and outer arcuate turn baffles 59*a* and 60*a*. FIG. 8 illustrates an alternative technique enabling overlapping which is described in greater detail in the above-referenced copending application which is hereby incorporated in its entirety herein wherein the corners of successive substrates are overlapped by providing a substrate entrance to the inverter which is at a level higher than the level of substrate transport in the inverter perpendicular to the direction of transport and the substrate exit from the inverter is at a level higher than the level of substrate transport from the inverter. For example, FIG. 8 is representative of substrate feed-in rolls 81 feeding a sheet S4 toward the right into the first substrate guide path 44, 45 while the segmented drive roll 51 (not shown) is feeding sheet S3 out of the Figure.

Figure 6:
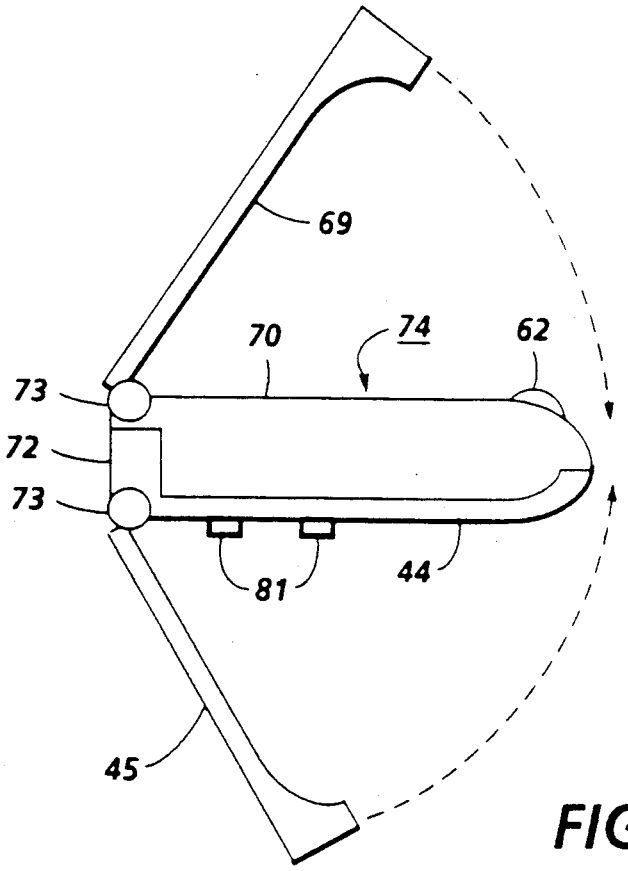
FIG. 6 is a sectional view illustrating the opening of the duplex cassette by raising the upper guide baffle and lowering the bottom sheet insertion baffle to enable substrate jam clearance.

The jam clearance feature is more readily illustrated with reference to FIG. 6 wherein the bottom substrate insertion baffle 45 and upper guide baffle 69 are illustrated as being supported by and hingedly attached to a rear support member to enable pivotable movement of them away from the top sheet insertion baffle and lower guide baffle 44 respectively to enable withdrawal of any jammed sheet. Thus, if a substrate jam or any other difficulty is encountered the cassette inverter may be removed form the main body of the printing machine, opened in a matter indicated in FIG. 6 and the jammed substrate removed or other appropriate action taken.

Figure 7:
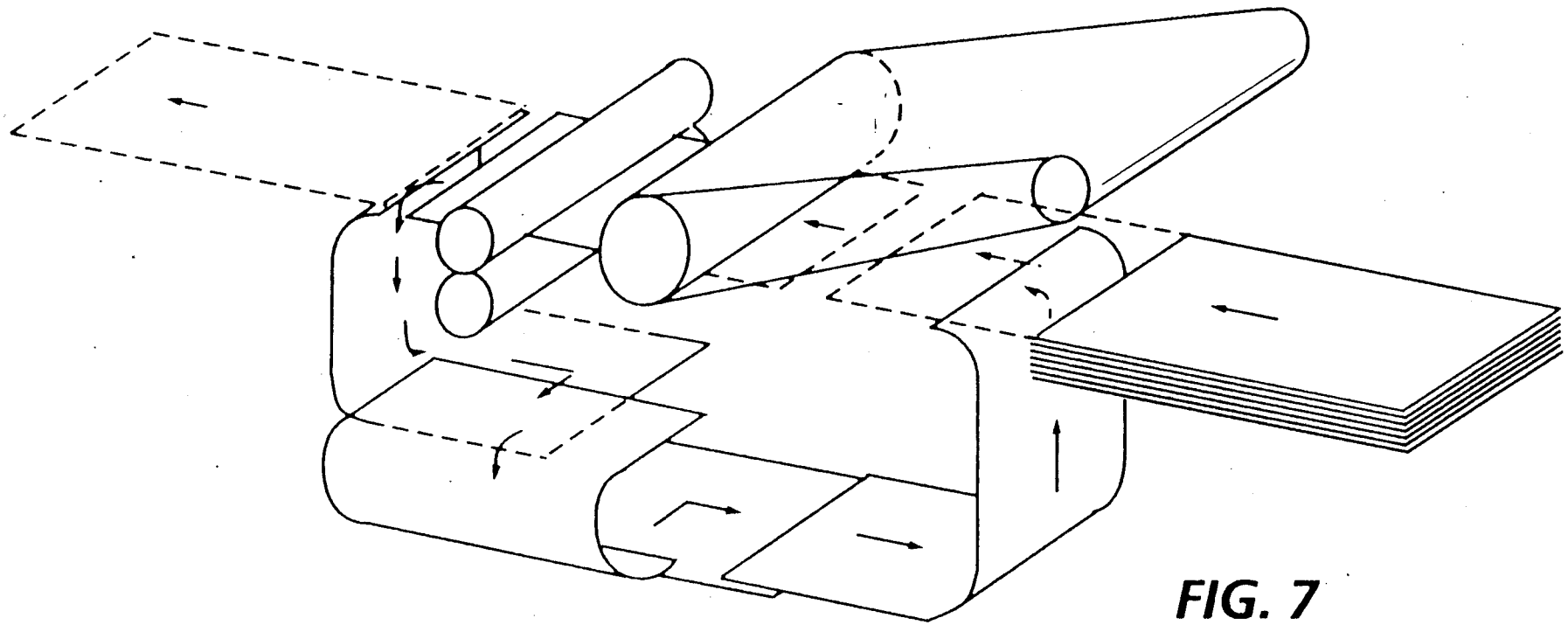
FIG. 7 is an isometric representation of an alternative embodiment wherein the print substrate enters the duplex cassette at the top and leaves the duplex cassette at the bottom.

FIG. 7 illustrates alternative embodiment of an inverting cassette wherein the substrate entering the inverting cassette enters at a level higher than it exits the inverting cassette and is inverted around the path from top to bottom.

As mentioned previously the various drive mechanisms are contained within an interior assembly 74 and include the substrate feed-in rolls, the rotatable segmented drive roll, the rotatable inverting drive rolls and the rotatable segmented registration roll. The substrate feed-in rolls 81 and the inverting drive rolls 62 may be constantly driven by motor 78 which may also be contained within the interior assembly 74. The rotatable segmented drive roll 51 and segmented registration roll 71 may also be driven by motor 78 through clutches 79 such as a solenoid actuated wrap spring clutches to provide only one turn to enable parking in the flat position thereby not interferring with the subsequent entry of the substrate to the first substrate guide path and second substrate guide path. As schematically illustrated in FIG. 1 the inventory cassette may be inserted and withdrawn from the main body of the copier from the front by sliding in and out on rails 85. As with other removable cassettes when a cassette is inserted into a printing machine conventional means are employed for the printing machine to identify the type of cassette, provide the necessary power and control signals for its appropriate operation.

Thus, according to the present invention, a relatively simple economical automatic duplex capability has been provided wherein book style duplex with portrait style images and pad style duplex with landscape images can be obtained in a printing machine that feeds print substrates short edge first.

Furthermore, it is possible to provide duplex capability for the relatively small, inexpensive low volume copier market at a relatively low price since it is only required to replace a conventional substrate cassette with a duplex inverting design cassette. This provides additional capability and selection for users in the low volume market. Furthermore, since the cassette is removable it may be exchanged for a new or different one if any mechanical or electrical difficulty arise. It has the further advantage of enabling rapid clearance of a substrate jam.

The disclosures of the patents and other documents referred to herein is hereby specifically and totally incorporated herein by reference.

While the invention has been described with reference to specific embodiments, it will be apparent to those skilled in the art that many alternatives, modifications and variations may be made. For example, while the invention has been illustrated with reference to a printing machine wherein the electrostatic latent image is formed by optically scanning an original it will be appreciated that the electrostatic latent image may be created in other ways such as by a modulated beam of light from a laser beam. Accordingly, it is intended to embrace all such alternatives and modifications as may fall within the spirit and scope of the appended claims.

I claim:

1. An automatic printing machine for producing successive duplex prints comprising means for forming an image on a print substrate, means for feeding successive print substrates to said image forming means to form an image on a first side of successive print substrates, means defining a substrate transport path to transport successive substrates having images on a first side to said image forming means to form images on the opposite side of said substrate, said substrate transport path including means to invert each successive substrate twice about an axis perpendicular to the direction of said path, a side shifting inverter to invert successive substrates once about an axis parallel to said path direction, said inverter comprising a first substrate guide means comprising a top sheet insertion baffle and a bottom sheet insertion baffle defining a portion of said substrate transport path, one of said top and bottom sheet insertion baffles having at least one aperture therein, a rotatable segmented drive roll having a flat segmented portion and a curved segmented portion, said curved portion extending through said aperture when said drive roll is rotated to be in substrate driving engagement with the remaining baffle, said flat segmented portion of said drive roll not extending through said aperture when adjacent said aperture, said inverter further including direction reversing arcuate substrate guide means to guide a substrate around a direction reversing path about an axis parallel to said path direction and means to transport a substrate through said arcuate guide means.

2. The printing machine of claim 1 wherein said direction reversing arcuate substrate guide means comprises an arcuate inner turn baffle and an arcuate outer turn baffle defining a portion of the substrate transport path therebetween, said inner turn baffle having at least one aperture therein and wherein said means to transport comprises at least one rotatable drive roll extending through said aperture into said substrate transport path for transporting a substrate.

3. The printing machine of claim 2 further including at least one spring shoe in engagement with said at least one drive roll forming a substrate driving nip therebetween.

4. The printing machine of claim 2 including downstream in the substrate transport path from said drive roll a second substrate guide means comprising an upper guide baffle and a lower guide baffle, and including means to deskew and register successive substrates along an edge parallel to the direction of the substrate transport path, said means to deskew and register comprising an aperture in one of said upper guide baffle and said lower guide baffle and a rotatable segmented registration roll having a flat segmented portion and a curved segmented portion, said curved portion extending through said aperture when said registration roll is rotated to be in substrate driving engagement with the remaining baffle, said registration roll being canted with respect to said registration edge to provide deskewing and registration of a substrate when a substrate is driven by said registration roll toward said registration edge.

5. The printing machine of claim 4 wherein a spring shoe is mounted on the remaining baffle to form a substrate driving nip between it and the curved segmented portion of said registration roll.

6. The printing machine of claim 1 wherein said inverter and a portion of said substrate transport path on each side of said side shifting inverter are included in a cassette removable from the printing machine.

7. The printing machine of claim 6 wherein said direction reversing arcuate substrate guide means comprises an arcuate inner turn baffle and an arcuate outer turn baffle defining a portion of the substrate transport path therebetween, said inner turn baffle having at least one aperture therein and wherein said means to transport comprises at least one rotatable drive roll extending through said aperture into said substrate transport path for transporting a substrate.

8. The printing machine of claim 7 further including at least one spring shoe in engagement with said at least one drive roll forming a substrate driving nip therebetween.

9. The printing machine of claim 7 including downstream in the substrate transport path from said drive roll a second substrate guide means comprising a upper guide baffle and a lower guide baffle, including means to deskew and register successive substrates along an edge parallel to the direction of the substrate transport path, said means to deskew and register comprising an aperture in one of said upper guide baffle and said lower guide baffle and a rotatable segmented registration roll having a flat segmented portion and a curved segmented portion, said curved portion extending through said aperture when said registration roll is rotated to be in substrate driving engagement with the remaining baffle, said registration roll being canted with respect to said registration edge to provide deskewing and registration of a substrate when a substrate is driven by said registration roll toward said registration edge.

10. The printing machine of claim 9 wherein a spring shoe is mounted on the remaining baffle to form a substrate driving nip between it and the curved segmented portion of said registration roll.

11. The printing machine of claim 6 wherein said cassette is interchangeable with a print substrate cassette.

12. The printing machine of claim 6 wherein a spring shoe is mounted on the remaining baffle to form a substrate driving nip between it and the curved segmented portion of said rotatable segmented drive roll when said roll is rotated through said aperture.

13. The printing machine of claim 6 further including means to feed a substrate onto said first substrate guide means.

14. The printing machine of claim 6 wherein the curved portion of the segmented drive roll has an arc sufficiently long to transport the lead edge of a substrate to the transport means for said arcuate guide means.

15. The printing machine of claim 1 wherein a spring shoe is mounted on the remaining baffle to form a substrate driving nip between it and the curved segmented portion of said rotatable segmented drive roll when said roll is rotated through said aperture.

16. The printing machine of claim 1 further including means to feed a substrate onto said first substrate guide means.

17. The printing machine of claim 1 wherein said substrate transport path sequentially includes first means to invert successive substrates about an axis perpendicular to the direction of said path, said inverter to invert successive substrates about an axis parallel to said path direction and a second means to invert successive substrates about an axis perpendicular to the direction of said path.

18. The printing machine of claim 1 wherein the curved portion of the segmented drive roll has an arc sufficiently long to transport the lead edge of a substrate to the transport means for said arcuate guide means.

19. A duplex cassette for use in an automatic printing machine for producing duplex prints, said cassette including a portion of the duplex print substrate path including a side shifting inverter to invert successive substrates once about an axis parallel to said path, said inverter comprising a first substrate guide means comprising a top sheet insertion baffle and a bottom sheet insertion baffle defining a portion of said substrate transport path, one of said top and bottom sheet insertion baffles having at least one aperture therein, a rotatable segmented drive roll having a flat segmented portion and a curved segmented portion, said curved portion extending through said aperture when said drive roll is rotated to be in substrate driving engagement with the remaining baffle, said flat segmented portion of said drive roll not extending through said aperture when adjacent said aperture, said inverter further including direction reversing arcuate substrate guide means to guide a substrate around a direction reversing path about an axis parallel to said path direction and means to transport a substrate through said arcuate guide means.

20. The cassette of claim 19 wherein said direction reversing arcuate substrate guide means comprises an arcuate inner turn baffle and an arcuate outer turn baffle defining a portion of the substrate transport path therebetween, said inner turn baffle having at least one aperture therein and wherein said means to transport comprises at least one rotatable drive roll extending through said aperture into said substrate transport path for transporting a substrate.

21. The cassette of claim 20 including downstream in the substrate transport path from said drive roll a second substrate guide means comprising an upper guide baffle and a lower guide baffle, upper aperture including means to deskew and register successive substrates along an edge parallel to the direction of the substrate transport path, said means to deskew and register comprising an aperture in one of said upper guide baffle and said lower guide baffle and a rotatable segmented registration roll having a flat segmented portion and a curved segmented portion, said curved portion extending through said aperture when said registration roll is rotated to be in substrate driving engagement with the remaining baffle, said registration roll being canted with respect to said registration edge to provide deskewing and registration of a substrate when a substrate is driven by said registration roll toward said registration edge.

22. The cassette of claim 21 wherein the inner and outer arcuate turn baffles each comprise an upper section and a lower section, and the upper section of the inner turn baffle is connected to the lower guide baffle of the second substrate guide means, the upper section of the outer guide baffle is connected to the upper guide baffle of the second substrate guide means, the lower section of the inner turn baffle is connected to the top substrate insertion baffle of the first substrate guide means and the lower section of the outer guide baffle is connected to the bottom substrate insertion baffle of the first substrate guide.

23. The cassette of claim 22 wherein the bottom substrate insertion baffle and upper guide baffle are supported by and hingedly attached to a rear support member to enable pivotal movement of said bottom sheet insertion baffle and upper guide baffle away from said top sheet insertion baffle and said lower guide baffle respectively.

24. The cassette of claim 23 wherein said top sheet insertion baffle and said lower guide baffle are arranged to form an interior assembly within said upper guide baffle and said bottom sheet insertion baffle said interior assembly including said at least one rotatable segmented drive roll, said at least one drive roll said rotatable segmented registration roll and means to drive said rolls.

25. The cassette of claim 24 wherein said first substrate guide means is positioned underneath said second substrate guide means and including at least one flexible substrate restraining finger to urge a substrate in the first substrate guide means toward the bottom sheet insertion baffle and at least one flexible substrate restraining finger to urge a substrate in the second substrate guide means toward the upper guide baffle.

26. cassette of claim 21 wherein a spring shoe is mounted on the remaining baffle to form a substrate driving nip between it and the curved segmented portion of said registration roll.

27. The cassette of claim 21 wherein said inner and outer arcuate turn baffle have raised rib portions to corrugate and thereby stiffen a substrate.

28. The cassette of claim 20 further including at least one spring shoe in engagement with said at least one drive roll forming a substrate driving nip therebetween.

29. The cassette of claim 19 wherein a spring shoe is mounted on the remaining baffle to form a substrate driving nip between it and the curved segmented portion of said rotatable segmented drive roll when said roll is rotated through said aperture.

30. The cassette of claim 19 further including means to feed a substrate onto said first substrate guide means.

31. The cassette of claim 19 wherein the curved portion of the segmented drive roll has an arc sufficiently long to transport the lead edge of a substrate to the transport means for said arcuate guide means.

* * * * *